US006837156B2

(12) United States Patent
Corbin et al.

(10) Patent No.: US 6,837,156 B2
(45) Date of Patent: Jan. 4, 2005

(54) TWIST TIE FEED DEVICE

(75) Inventors: John C. Corbin, Neshanic Station, NJ (US); Dimitrios Manoussakis, Wyckoff, NJ (US)

(73) Assignee: Ben Clements & Sons, Inc., South Hackensack, NJ (US)

( * ) Notice: Subject to any disclaimer, the term of this patent is extended or adjusted under 35 U.S.C. 154(b) by 0 days.

(21) Appl. No.: 10/455,010

(22) Filed: Jun. 4, 2003

(65) Prior Publication Data

US 2004/0244607 A1 Dec. 9, 2004

(51) Int. Cl.[7] ..... B65B 13/28; B21F 9/02

(52) U.S. Cl. ..... 100/26; 100/31; 100/32; 53/138.8; 53/589; 140/93.6

(58) Field of Search ..... 100/26, 31, 32; 53/138.8, 589, 138.6; 140/93.6, 93 A

(56) References Cited

U.S. PATENT DOCUMENTS 3,318,230 A * 5/1967 Hilton ..... 100/4
3,428,096 A * 2/1969 Golovkina et al. ..... 140/93.6
3,898,924 A * 8/1975 Mead et al. ..... 100/12
4,177,842 A * 12/1979 Dilley ..... 140/93.6
4,559,977 A * 12/1985 Dilley ..... 140/93.6
5,121,682 A * 6/1992 Parker et al. ..... 100/26
5,836,137 A 11/1998 Contreras et al.

* cited by examiner

*Primary Examiner*—Allen Ostrager
*Assistant Examiner*—Jimmy Nguyen
(74) *Attorney, Agent, or Firm*—Stroock & Stroock & Lavan LLP

(57) ABSTRACT

A twist tie feed device is provided for twisting together the ends of a tie ribbon which encircles a product including a base plate. A twist head assembly can be mounted on a base plate and receives a first end of a tie ribbon which encircles the product and a second end of the encircling tie ribbon and will rotate about itself to twist the tie ribbon about the product. Positive drive wheels and idler working in conjuction feed the ribbon in one of a first direction towards the twist head assembly and a second direction away from the twist head assembly. The positive drive wheels can contact the ribbon at one side and the idler can contact the ribbon on the other side to apply a positive drive force to the drive the ribbon as it passes between the drive wheels and idler. The ribbon can be fed in the second direction away from the twist head assembly, thereby tightening the ribbon about the product. Once the ribbon attains a certain tension, a microprocessor can cease the ribbon feed, whereupon the ribbon can be tied and the twist head assembly can twist the ribbon about the article.

22 Claims, 3 Drawing Sheets

TWIST TIE FEED DEVICE

BACKGROUND OF THE INVENTION

1. Field of the Invention

This invention relates generally to an improved twist tie feed device which can be used for tying a group or bundle of items, for example, celery, asparagus, broccoli and the like, and more particularly to an improved twist tie feed device utilizing an electric and pneumatic hybrid drive system.

2. Description of Related Art

Prior art patents teach the development of machines which effectively apply a tie wire about products to protect those products in transit prior to retail sale. The tie is a generally malleable wire sandwiched between two strips of paper secured together, for example with adhesive, to form a generally flat ribbon. The ribbon may also consist of plastic ribbon having a narrow center stripe of greater height than the adjoining areas. After a snug loop of ribbon is formed around the product, the ends of the ribbon are clamped. These clamped ends are then rotated about a central axis producing a permanent twist in the tie ribbon whereby the loop and product are held together. In the known manner, the ribbon can be untwisted by the purchaser of the product and retwisted when it is desired to re-apply the ribbon. These procedures have become most familiar to consumers, with twist ties being used on many products, not only to hold the above mentioned products together, but to provide closure for paper and plastic bags containing foodstuffs and other items and in larger sized bags used for containing potatoes, onions, etc.

Many operational steps are required to apply a twist tie in the form of a wire/paper ribbon. In the past, complex machinery has been designed to effect performance. These machines as illustrated for example, in U.S. Pat. No. 3,318,230 issued May 9, 1967; U.S. Pat. No. 3,428,096 issued Feb. 18, 1969; U.S. Pat. No. 3,898,924 issued Aug. 12, 1975 and U.S. Pat. No. 4,177,842 issued Dec. 11, 1979, each of which are hereby incorporated by reference, are machine constructions relying on complex mechanisms, electrically driven in some instances, and generally using cam devices to provide sequential motions necessary to effect the procedural steps in applying a twist tie ribbon to the product. Each progressive patent generally teaches an improvement in performance and simplification in structure. However, endless belt chain drives, pulleys, and complicated linkage systems are not uncommon, and the need for adjustment for operation and to compensate for temperature variation and for wear can be relatively frequent. Use of both a forward feed drive for the ribbon and also an independent reverse feed drive for tightening the ribbon about the bundle is also disclosed in the prior art, further adding to the complexity of such prior art systems.

It is also known from U.S. Pat. No. 4,559,977 issued on Dec. 24, 1985, which is hereby incorporated by reference, to provide a pneumatic twist tie feed device for providing a helical wrap about the package. This device utilizes a first gripper which clamps and retains the free end of the ribbon against a second gripper. Pressure rollers operate in reverse retracting excess ribbon about the produce. A friction clutch, operative only for reverse ribbon feeding, allows for ribbon slippage as the ribbon tightens around the produce. Then the second gripper clamps the other end of the ribbon against the twister head and a twister mechanism rotates the clamped ends of the ribbon about a common axis twisting the ribbon ends together. Axial gripping motion is provided by cylindrical valves having pistons concentric with and supported by a gripper support rod tube and acting, respectively at the ends of the gripper supports away from the tie ribbon. A rack and pinion mechanism is used to provide rotation of twister mechanism and forward and reverse feeding of the ribbon. All components are pneumatically driven.

While this prior art device has been somewhat satisfactory for its intended purpose, it has also proven to be overly complex for many applications, requiring the simultaneous control of several pneumatic valves and solenoids. Additionally, because the ring was a helical ring, if the helical wrap became shifted to be perpendicular to the bundle, the wrap became loose. Additionally, only a single forward drive wheel was utilized in conjunction with an idler so that during reverse driving, the idler had to be removed from contact with the ribbon, while an accumulator rod was utilized to pull and tension the ribbon in a backward feeding direction.

U.S. Pat. No. 5,121,682 issued on Jun. 16, 1992 to Parker et al., which is hereby incorporated by reference, teaches an improvement on the prior art devices by providing an electric twist tie feed device with a circular wrap, positive drive rollers and a sensor. The positive drive rollers contact the ribbon on either side and feed the ribbon to the circular wrap, moving in the opposite direction to retract any excess ribbon from the ring. A sensor determines when to stop retracting the ribbon to prevent damage to the product being tied.

Although satisfactory, this device uses numerous clutches and brakes, which typically need to be periodically gapped and periodically require the use of lubricants, which can result in lost torque and other problems. Additionally, the parts can wear out, making it difficult to maintain torque.

Accordingly, a need exists for a twist tying machine which is simple and reliable in construction, and reduces the total number of parts, which can provide a circular wrap and may perform wrapping without the use of an accumulator or clutches and brakes.

SUMMARY OF THE INVENTION

Generally speaking, in accordance with the present invention, an improved twist tie feed device especially suitable for tying bundles is provided. As described in more detail below, when produce or the like is placed on a work table at the preferred position in relation to the twist tie feed device of the present invention, a ring encircles the bundle and the tie ribbon is fed by positive drive wheels and an idler acting in tandem, around the inner periphery of the ring to form a complete loop. A first gripper then clamps and retains the free end of the ribbon encircling the product. The positive drive wheels are then driven in a reverse direction to extract excess ribbon from the ring and provide a snug fit for the ribbon about the produce. The idler preferably reacts to the direction of tie ribbon feed and will apply pressure on the tie ribbon against the drive wheel which is downstream mn the tie ribbon path, regardless of whether the tie ribbon is being fed to the ring or back into the ribbon supply drum, in order to provide guidance and prevent misfeed in whatever direction the tie ribbon is being fed. A microswitch proximate to the idler causes the rollers to stop feeding in the reverse direction, thus preventing damage to the produce, once a predetermined tightness is present and the microswitch is activated. The second gripper then clamps the other attached end of the ribbon such that both ends of the ribbon are now constrained. A cutting mechanism severs the engaged ribbon from the ribbon supply when the second gripper clamps the other attached end of the ribbon. A twister mechanism rotates the clamped ends of the ribbon about a central axis so that the wire within the ribbon is twisted and the ribbon ends are joined together in the process of twisting.

As described in more detail below, the ring forms a concentric circle about the bundle so that the ribbon is pulled about the bundle perpendicular thereto. The grippers and twister mechanism includes a first gripper parallel to a second gripper so that when the tie ribbon is held by the first gripper and second gripper the two ends of the tie ribbon overlap each other. A pneumatic cylinder mechanism is preferably coupled to each of the first and second grippers so that by the retracting the cylinders, the grippers are closed. The cylinder mechanism is preferably a pneumatic spring retractable cylinder, requiring an air source to extend and automatically retracting once the air source is removed since the spring has been compressed. When both grippers are closed, the cutting mechanism can cut the ribbon and the entire twist head is rotated a predetermined number of times to twist the ribbon about the bundle. A programmed logic control (PLC) is provided to control the different mechanisms of the invention, including the amount of ribbon which is fed through the twist tie device, the opening and closing of the ring and grippers, the driving of the positive drive wheels and the rotation of the twist head.

Accordingly, it is an object of the invention to provide on improved twist tying machine which is more simple and reliable in operation.

Another object of this invention is to provide an improved twist tying machine which has a minimum number of parts, is simple to construct and requires reduced or little maintenance.

A further object of this invention is to provide an improved twist tie device which allows for adjustments in the pressure placed on the bundle by the tie ribbon.

Yet another object of this invention is to provide an improved twist tie device which allows for extracting excess ribbon and forward feeding of the ribbon during tying without the use of an accumulator.

Still another object of this invention is to provide an improved twist tie device which does not use clutches and brakes.

A further object of this invention is to provide an improved twist tie feed device which provides a tied bundle having the ribbon fastened perpendicularly about the bundle.

Still other objects and advantages of the invention will in part be obvious and will in part be apparent from the specification.

The invention accordingly comprises the features of construction, combinations of elements, and arrangements of parts which will be exemplified by the constructions hereinafter set forth and the scope of the invention will indicated in the claims.

BRIEF DESCRIPTION OF THE DRAWING FIGURES

DETAILED DESCRIPTION OF THE EXEMPLARY EMBODIMENTS

The general operation of the twist tying feed devices is generally known from the above cited patents, the contents of which are incorporated herein by reference. In particular, a product, for example, a bundle of asparagus stalks, a bunch of celery, a rolled-up newspaper, a bag or the like can be held together by a tie ribbon 14 (FIG. 2) which comprises a strand of wire sandwiched between two flat paper strips which can be adhesively joined together. The paper strips may be replaced with thin plastic strips joined together or, the entire tie ribbon 14 may be formed of a single plastic strip of varying widths. A length of tie ribbon 14 can encircle the product and the wire is then twisted. Because the wire is malleable and takes a set when twisted, the product remains encircled until the tie ribbon 14 is untwisted by the product customer.

Figure 1:
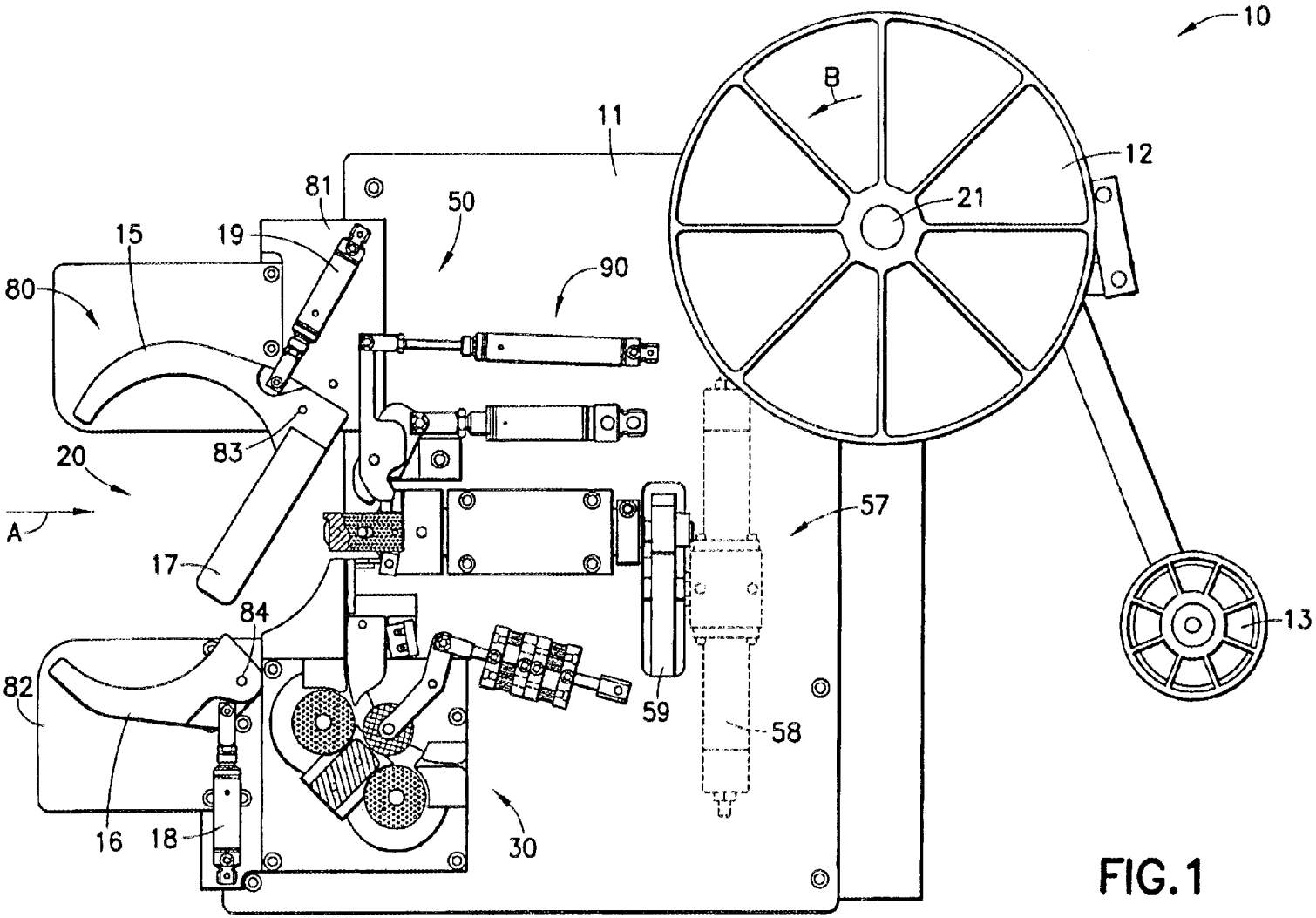
FIG. 1 is a top plan view of a twist tie feed device constructed in accordance with an embodiment of the present invention.

With reference to FIG. 1, one embodiment of an improved twist tie feed device 10 in accordance with the invention comprises a base plate 11, twist head assembly 50, ribbon supply drum 12 and positive drive mechanism 30. It should be noted that base plate 11 is illustrated in a horizontal position by way of example only. The operation to be discussed in detail below may also be performed with base plate 11 in a vertical or other orientation. Additionally, an enclosure may be provided about base plate 11 such that only the twist head assembly 50 including the rings 15, 16 is exposed, thereby protecting the moving parts.

The twist head assembly 50 of the embodiment shown in FIG. 1 generally comprises a ring mechanism 80 and a gripper mechanism 90. The ring mechanism generally includes a first ring 15 and a second ring 16. The product to be tied is positioned in a slot 20 formed within base plate 11 extending to twist head assembly 50 and is positioned adjacent twist head assembly 50. As illustrated in FIG. 1, a preferred embodiment of the invention includes first ring 15 pivotably mounted by a pivot pin 83 to a block portion 81 which can be mounted to base plate 11. First ring 15 can also be pivotally attached to first ring cylinder 19 as to rotate about pivot pin 83 when pulled or urged by first ring cylinder 19. Similarly, second ring 16 is pivotally mounted to the base plate 11 about a pivot pin 84 and also pivotally attached to second ring cylinder 18. The cylinder 18 can urge the second ring 16 to remain open and urge it to close according to the direction from a PLC. First ring 15 can be pivoted towards second ring 16 to encircle a product (not shown), forming by connection with second ring 16, a single continuous circular loop. Many different mechanisms can be used to close the ring. For example, a foot pedal can be used to activate the ring closure. Alternatively, a bar 17 preferably fixedly connected to first ring 15 (or second ring 16) can be pushed manually to initiate the ring closure. A magnetic sensor can be present, permitting the ring to complete being closed and letting the system take control thereafter.

Both first ring 15 and second ring 16 include an inner guide channel (not shown) dimensioned to continuously guide tie ribbon 14 around the ring. Tie ribbon 14 enters twist head assembly 50 and moves around first ring 15 in the guide channel and passes through second ring 16 to complete a circular loop about the product. Because tie ribbon 14 is stiff yet malleable, the guide channel can guide ribbon 14 about the ring as tic ribbon 14 is fed.

Figure 3:
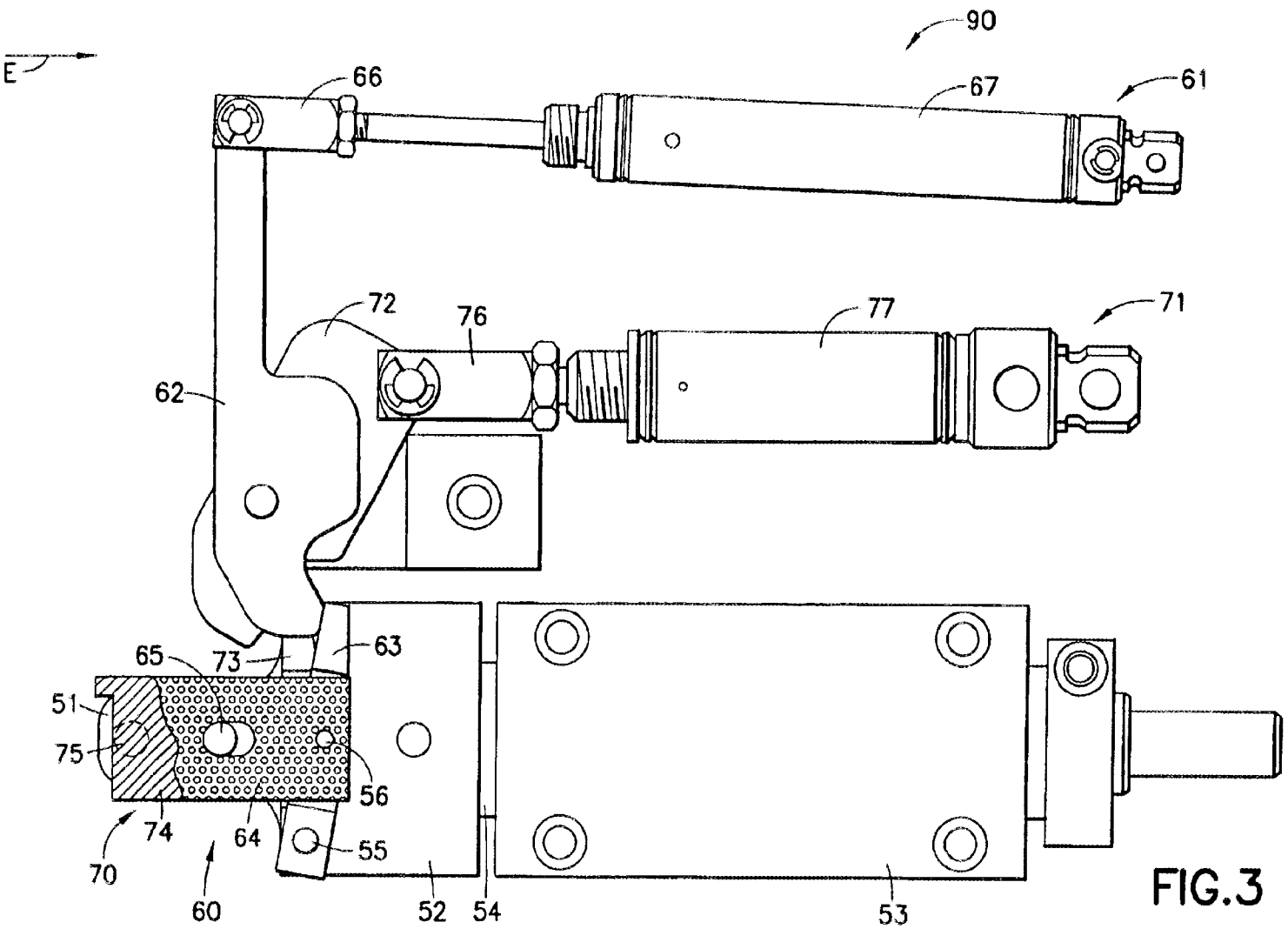
FIG. 3 is a top plan view of the twist head and cylinders of a twist tie feed device constructed in accordance with an embodiment of the present invention.

The gripper mechanism can comprise a plurality of grippers and corresponding cylinder mechanisms preferably proximate the grippers. FIG. 3 shows an embodiment of a gripper mechanism generally indicated as 90, comprising two grippers 70, 60, a base panel 51 connected to twist head 52, two gripper covers 64, 74 and two corresponding cylinders 61, 71. The first gripper 70 can comprise first cover 74 slidably movable over base panel 51 to open and close first aperture 75, indicated by the dashed lines. Similarly, second gripper 60 can comprise second cover 64 slidably movable over base panel 51 to open and close second aperture 65. The cylinder mechanisms 71, 61 are preferably a pneumatic spring retractable cylinders, extending when an air source is provided and retracting automatically when the air source is removed, and control covers 74, 64 and thereby apertures 75, 65. As shown in FIG. 3, cylinder mechanisms 71, 61 comprise cylinders 77, 67 which extend and retract and heads 72, 62 pivotally attached to the base plate 11 and to arms 76, 66 extending from cylinders 77, 67. When cylinders 77, 67 are extended, heads 72, 62 preferably engage levers 73, 63 which pivot about point 55. Covers 74, 64 are pivotally attached to levers 73, 63 and therefore pivot about point 56 and move in direction E, opening apertures 75, 65. When cylinders 77, 67 are retracted, heads 72, 62 disengage levers 73, 63, thereby closing apertures 75, 65.

The twist head assembly can further comprise a cutting mechanism, such as a scissor cut device mounted below the base plate. The cutting mechanism (not shown), upon closing of both grippers, can shear tie ribbon 14 thereby facilitating the twisting of tie ribbon 14.

In a preferred embodiment of the invention, the twist head assembly comprises a twist head 52 which is attached to a twist cylinder 54 within housing 53. A rotating actuator 57, which is commonly known in the art, can be used to rotate the cylinder 54 which results in twisting the twist head 52. As shown in FIG. 1, the rotating actuator 57 can comprise pully and timing belt 59 mounted on base plate 11 adjacent to and coupled with twist cylinder 54 and rotary cylinder 58 mounted on the opposite side of base plate 11 from the pully and timing belt 59. Preferably, the twist head 52 is fixedly coupled to grippers 70 and 60, thereby twisting the ends of tie ribbon 14 with respect to each other and producing the tie.

Figure 2:
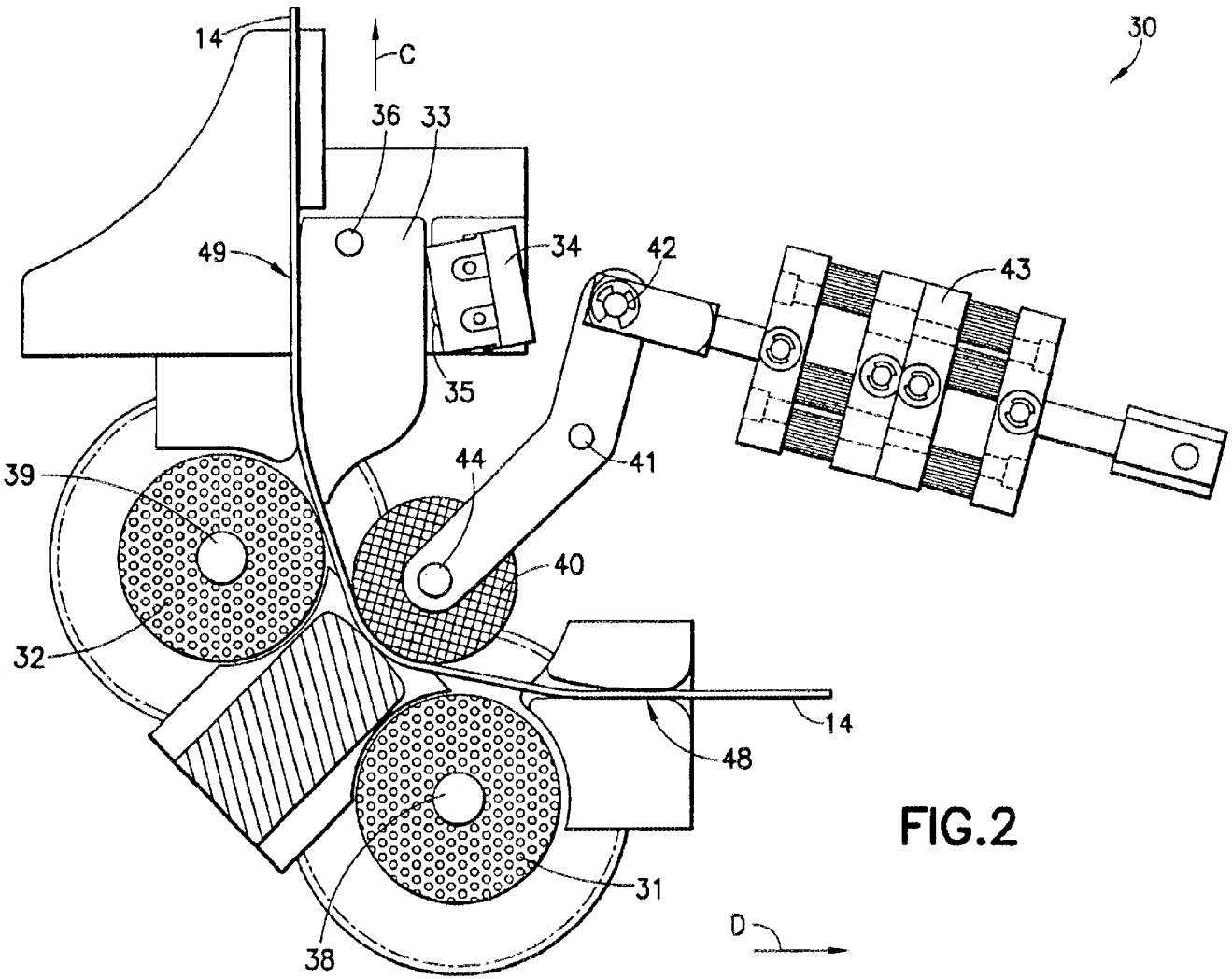
FIG. 2 is a top plan view of the drive mechanism of a twist tie feed device constructed in accordance with an embodiment of the present invention.

As seen in FIG. 1, tie ribbon 14 can be threaded from ribbon supply drum 12 rotatably mounted to the base plate 11 about an axis 21, around and past guide wheel 13 present along the travel path of tie ribbon 14 until it reaches the drive mechanism 30, which generally comprises drive wheels 31, 32 and idler 40. As seen in FIG. 2, drive wheels 31, 32 can be rotatably mounted about axes 38 and 39 respectively, drivingly rotating to feed ribbon 14 through a ribbon feed chute 49 through which tie ribbon 14 feeds the rings 15 and 16.

The idler 40 is preferably located on the opposite side of the ribbon from the positive drive wheels 31 and 32, applying sufficient pressure to tie ribbon 14 against drive wheels 31, 32. Therefore when drive wheels 31, 32 rotate, tie ribbon 14 is fed in the direction of arrow C (FIG. 2) into chute 49 and is fed out of chute 49 in the direction of arrow D. In a preferred embodiment of the invention, the idler 40 pivots about point 41 toward tension lever 33, applying a controlled amount of pressure on tie ribbon 14 against drive wheel 32 when the ribbon is being fed toward the twist head. The idler 40 can pivot about point 41 away from tension lever 33, applying a controlled amount of pressure on tie ribbon 14 against drive wheel 31 when the ribbon is being retracted away from the twist head. In a preferred embodiment, idler 40 can include an encoder to ensure the idler 40 rotates only when tie ribbon 14 is being fed or retracted, as well as to try to feed tie ribbon 14 when not a sufficient amount of ribbon had been fed. The idler 40 can also be pivotally attached to a spring mechanism 43 controlled by PLC which extends and retracts, thereby pivotally moving idler 40 about point 41.

The drive mechanism can also comprise tension lever 33 and microswitch 34 including a button 35. Preferably, when tie ribbon 14 is retracted until the desired tension is acquired, the tension of tie ribbon 14 will move the tension lever, preferably pivotally attached at point 36, to depress button 35, thereby triggering microswitch 34. This can cause PLC to terminate the driving of drive wheels 31, 34.

A sample operation of a preferred embodiment of the invention is as follows: A product is placed in slot 20 in direction A and bar 17 is pushed toward the twist head assembly 50, thereby pivotally moving first ring 15 and second ring 16 toward each other, closing the ring. PLC thereafter controls the mechanisms of the invention to feed the ring and extract surplus tie ribbon 14 and twist the twist head 52 thereby tying the tie ribbon 14.

Tie ribbon 14 can be supplied continuously from a ribbon supply drum 12, unwinding as needed, wrapping around guide wheel 13 which is present along the travel path of ribbon 14 as a guide. Tie ribbon is moved through chute 48 and engages drive wheel 32 and idler 40, whereupon the drive wheel 32 and idler 40 rotate about axes 39 and 44, respectively, to drive tie ribbon 14 in direction C.

Drive wheel 32 of the preferred embodiment is driven by a motor controlled by PLC and idler 40 applies a predetermined pressure on tic ribbon 14 toward drive wheel 32 to prevent slippage and misfeed while avoiding damaging tie ribbon. Tie ribbon 14 is moved through chute 49 and into second aperture 65 of second gripper 60. The cylinder of the second cylinder mechanism is preferably extended, thereby keeping second aperture 65 open. Tie ribbon 14 travels through the second aperture 65 of second gripper 60 and around first ring 15 and second ring 16, traveling in the inner guide channel 25 which guides tie ribbon 14 around the ring. A length of tie ribbon 14 sufficient to follow the inner ring periphery is fed for the product. The leading end of tie ribbon 14 is engaged by first gripper 70 (FIG. 3), wherein the first cylinder mechanism 71 retracts second cylinder 77 and moves first gripper cover 74 slidably over first aperture 75, thereby clamping the leading end of tie ribbon 14. Then the attached end of the loop of tie ribbon 14 is withdrawn from the ring, tightening tie ribbon 14 around the product.

In the steps of the preferred embodiment being described, tie ribbon 14 is retracted by driving drive wheel 31 in direction D, the reverse direction from when tie ribbon 14 was being fed to the ring. Referring to FIGS. 1 and 2 and consistent with the preferred embodiment being described, drive wheel 31 rotates clockwise in order to move tie ribbon 14 in direction D, thereby feeding tie ribbon 14 back to ribbon supply drum 12. Tension lever 33 is preferably adapted to pivot toward microswitch 34 when tie ribbon reaches a predetermined tension. When the tension is reached, tie ribbon 14 urges tension lever 33 to pivot about point 36 toward microswitch 34, depressing button 35. Once button 35 is depressed, PLC stops the drive wheels from retracting tie ribbon 14 any further.

Second cylinder mechanism preferably then retracts, moving second gripper cover 64 slidably above second aperture 65 to clamp the attached end of tie ribbon 14. A cutting mechanism preferably mounted on the opposite side of the base plate 11 from the gripper mechanism can be then activated by PLC to sever tie ribbon 14 proximate second gripper 60. The cutting mechanism can be one of various types, including a scissor cut mechanism positioned between lever 17 and twist head assembly 50.

A preferred embodiment of the invention can create a controlled length of slack by refeeding tie ribbon 14 out a certain amount, depending on the length of slack desired. The wider the circumference of the product being tied, the longer the slack desired. More preferably, an embodiment of the invention can include a dial on the device to set the slack desired, which can be done in numerous ways including predetermining counts of drive wheel 31 or idler 40 rotations.

Twister head 52, fixedly coupled to cylinder 54 and both grippers 60 and 70 can be rotated to tie the tie ribbon. The rotating actuator 57 rotates twist cylinder 54 and therefore rotates twist head 52 while the ends of ribbon 14 are fixedly restrained, hence twisting the ends of tie ribbon 14 with respect to each other and producing the tie.

It will thus be seen that the objects set forth above, among those made apparent from the preceding description, are efficiently attained and, since certain changes may be made in the above construction without departing from the spirit and the scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A twist tie feed device for twisting together the ends of a tie ribbon encircling an article which is positioned therein for tying comprising:

a twist head assembly constructed to receive and grasp a first end of said tie ribbon and a second end of said encircling tie ribbon and rotate about itself to twist said tie ribbon about an article and form a tie extending away from said article, said twist head assembly including:

a first gripper adjacent to a position at which an article is to be placed for tying, the first gripper being operatively coupled to a first pneumatic cylinder and including a movable covering being movable via said first pneumatic cylinder so as to provide a first open position providing an aperture through which a tie ribbon can pass therethrough and a first closed position wherein said aperture is closed, thereby clamping a first end of said tie ribbon, and a second gripper adjacent to the position at which an article is to be placed for tying, the second gripper being operatively coupled to a second pneumatic cylinder and including a movable covering being movable via said second pneumatic cylinder so as to provide a second open position providing an aperture through which said tie ribbon can pass therethrough and a second closed position wherein said aperture is closed, thereby clamping a second end of said tie ribbon so that said first end of said tie ribbon substantially overlaps said second end of said tie ribbon;

a rotator coupled to said first gripper and second gripper for rotating said first gripper and second gripper in unison about a common axis so that when the first gripper and second gripper are in the first closed position and second closed position respectively, the clamped ends of the tie ribbon will be twisted relative to each other, said rotator being coupled to a positive driver;

said positive driver positioned along a feed path of the tie ribbon for selectively feeding said tie ribbon in one of a first direction toward said twist head assembly and in a second direction away from said twist head assembly, said tie ribbon having a first side and a second side, said positive driver including:

one or more drive rollers contacting said tie ribbon at said first side of said tie ribbon to apply a positive drive force to said first side of said tie ribbon as it passes through said positive driver and an idler contacting said tie ribbon at said second side to apply a pressure on said tie ribbon toward said one or more drive rollers wherein said idler is movable to adjust to the direction of ribbon feed.

2. The twist tie device of claim 1, further comprising a rotating actuator coupled to said twist head assembly.

3. The twist tie device of claim 1, wherein said first pneumatic cylinder and second pneumatic cylinder are spring retractable cylinders.

4. The twist tie device of claim 1, wherein said first pneumatic cylinder comprises a head adapted to engage a lever which controls said movable cover.

5. The twist tie device of claim 1, wherein said second pneumatic cylinder comprises a head adapted to engage a lever which controls said movable cover.

6. The twist tie device of claim 1, wherein said movable coverings are slidably movable.

7. The twist tie device of claim 1, wherein said positive driver comprises two drive rollers.

8. The twist tie device of claim 1, wherein said one or more drive rollers act independent from one another.

9. The twist tie device of claim 1, wherein one of said one or more drive rollers controls said tie ribbon at one time, dependent on the direction of feed.

10. The twist tie device of claim 1, wherein said idler is pivotally movable.

11. The twist tie device of claim 1, wherein said idler engages one of said one or more drive rollers at one time, dependent on the direction said tie ribbon is fed.

12. The twist tie device of claim 1, wherein said idler engages one of said one or more drive rollers which is farthest downstream in the direction said tie ribbon is fed.

13. The twist tie device of claim 1, further comprising an encoder coupled to said idler.

14. The twist tie device of claim 1, further comprising a microswitch, which when activated, causes the feeding of said tie ribbon to stop.

15. The twist tie device of claim 14, further comprising a tension lever wherein said tension lever activates said microswitch.

16. The twist tie device of claim 15, wherein said tension lever is pivotally moveable to contact said microswitch.

17. The twist tie device of claim 14, wherein said microswitch comprises a button.

18. The twist tie device of claim 17, further comprising a tension lever is wherein said tension lever depresses said button.

19. The twist tie device of claim 18, wherein said tension lever is pivotally movable to contact said button.

20. The twist tie device of claim 1, further comprising a slack determining device.

21. The twist tie device of claim 20, wherein said slack determining device refeeds said tie ribbon to said twist head assembly a predetermined length.

22. The twist tie device of claim 20, wherein said slack determining device includes a dial.

* * * * *